US007927129B2

(12) United States Patent
Gimbel

(10) Patent No.: US 7,927,129 B2
(45) Date of Patent: Apr. 19, 2011

(54) ELECTRICAL CONNECTOR HAVING CABLE SECURING DEVICE

(75) Inventor: Markus Gimbel, Baar-Ebenhausen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 180 days.

(21) Appl. No.: 12/305,858

(22) PCT Filed: Jun. 9, 2007

(86) PCT No.: PCT/EP2007/005107

§ 371 (c)(1), (2), (4) Date: Dec. 19, 2008

(87) PCT Pub. No.: WO2007/147492

PCT Pub. Date: Dec. 27, 2007

(65) Prior Publication Data

US 2010/0233900 A1 Sep. 16, 2010

(30) Foreign Application Priority Data

Jun. 20, 2006 (DE) ..... 10 2006 028 202

(51) Int. Cl.
*H01R 13/58* (2006.01)

(52) U.S. Cl. ..... 439/467; 439/470

(58) Field of Classification Search ..... 439/467, 439/464, 470, 472, 466, 446; 174/660
See application file for complete search history.

(56) References Cited

U.S. PATENT DOCUMENTS

| | | | | |
|---|---|---|---|---|
| 4,200,350 | A | 4/1980 | Zimmerman, Jr. | |
| 4,537,456 | A * | 8/1985 | Brown et al. | 439/404 |
| 4,538,874 | A | 9/1985 | Dambach et al. | |
| 5,037,325 | A * | 8/1991 | Wirkus | 439/467 |
| 5,516,984 | A * | 5/1996 | Soes et al. | 439/467 |
| 5,941,728 | A * | 8/1999 | Okabe et al. | 439/467 |

FOREIGN PATENT DOCUMENTS

| | | | |
|---|---|---|---|
| DE | 4015793 | C2 | 9/1994 |
| DE | 4427674 | A1 | 2/1995 |
| WO | WO 2007147492 | A1 * | 12/2007 |

* cited by examiner

*Primary Examiner* — Hae Moon Hyeon
(74) *Attorney, Agent, or Firm* — Barley Snyder LLC

(57) ABSTRACT

An electrical connector is provided with a hinged cover, which is connected in one piece to a connector housing. At least one guide slot is formed in a cover portion of the cover and opens outwards towards a free end of the cover portion. A cable is positioned in the guide slot upon closing the cover, and the guide slot is constricted when the cover is closed so that the cable is fixed inside it. The result is a secure fixing of the cable with low cost in terms of parts and assembly.

11 Claims, 6 Drawing Sheets

ELECTRICAL CONNECTOR HAVING CABLE SECURING DEVICE

CROSS-REFERENCE TO RELATED APPLICATIONS

This application is a National Stage Application filed under 35 U.S.C. §371 of PCT/EP2007/005107, filed on Jun. 9, 2007, which claims priority of German Application No.: DE 10 2006 028 202.7, filed Jun. 20, 2006.

FIELD OF THE INVENTION

The invention relates to an electrical connector, and particularly relates to a socket or plug, which, together with the respective mating connector, serves in particular to establish an electrical connection in motor vehicles. The invention also relates to a connector housing.

BACKGROUND

Electrical connectors for the detachable mechanical connection or locking of electrically conductive connections are known in numerous embodiments. In the case of connectors, the cables are connected, often with crimps, to contacts, which are locked inside a contact cavity arranged inside the connector housing.

A requirement is placed on electrical connectors that cable stresses, like cable movements or vibrations, for example, which are not untypical in harsh environmental conditions such as motor vehicles, may not be transferred to the connection between the cable and the contact. Certain stresses can, of course, be kept away from the contact by a separate cable securing device, which is arranged behind the plug. However, such a design includes higher costs in terms of parts and assembly.

Many different kinds of cable securing devices are known in connection with connectors.

For example, conventional cable positioners and/or cable binders can be integrated into connectors. An electrical connector, which is protected from water penetration, is known from DE 40 15 793 C2, in which a cable positioner provided with cable insertion slots to position a cable, which has been provided with a seal, is provided, as well as another seal, which has been fixed onto the positioner from the outside and is constructed as a cap. The other seal can be connected to the positioner in one piece, via hinged connectors. The leads are, however, not sufficiently fixed inside the cable positioner.

Apart from that, a large number of securing devices are known, which serve to lock the contact inside the connector. A retaining device is known from U.S. Pat. No. 4,200,350, for example, with an almost L-shaped hinged cover, which is connected in one piece with the connector housing, there being notches provided on the free end of the free side, which each form a respective feed-through, together with corresponding notches on the housing, when the cover is closed. The intermediate portions of the cover, which separate the notches, fix the contacts. The cables are not fixed in the feed-throughs that are formed when the cover is closed.

SUMMARY

The present invention is made in view of the technical problem described above, and it is an object of the present invention to provide a sufficiently strong fixing of the cables inside the connector at low cost in terms of parts and assembly, in order to keep cable stresses away from the contact.

It is further an object of the invention to provide an electrical connection in motor vehicles, with a connector housing having a plug side and a cable feed side, a hinged cover that is connected in one piece to the connector housing and arranged between the plug and cable feed sides. A portion of the cover forms part of the connector housing on the cable feed side when the cover is closed. Further, at least one guide slot is formed in the cover portion, which opens outwards towards the free end of the cover portion, in which at least one associated cable can be positioned upon closing the cover, while the guide slot is constricted so that the cable is fixed inside it.

BRIEF DESCRIPTION OF THE DRAWINGS

The invention will be explained in greater detail in the following with reference to embodiments, referring to the appended drawings, in which.

DETAILED DESCRIPTION OF THE EMBODIMENT(S)

Embodiments of the connector, according to the invention, are described in more detail in the following description referring to the attached drawings.

Figure 1:
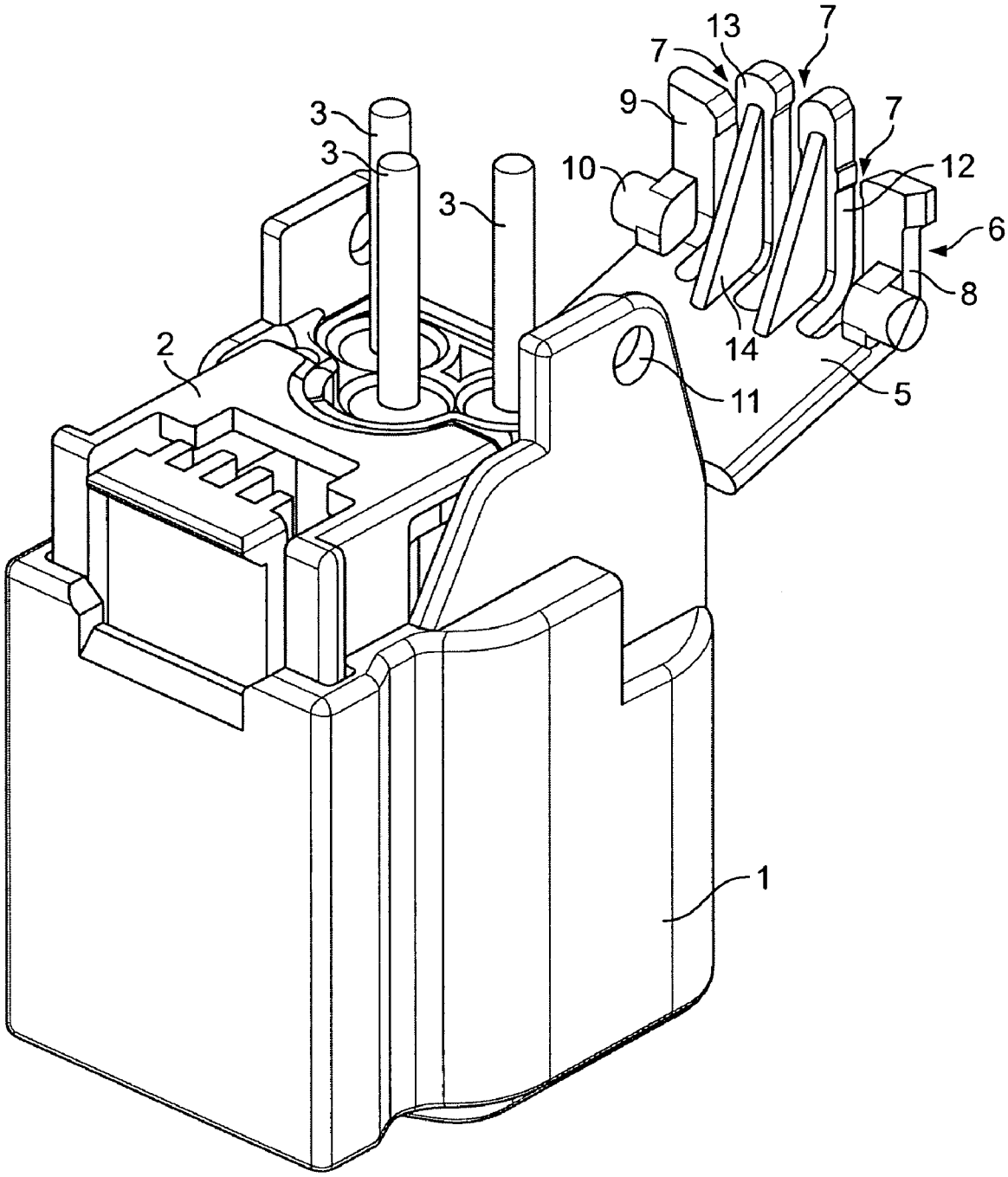
FIG. 1 is a perspective view of a connector, according to a first embodiment of the invention, in which the cover is open.
Figure 2:
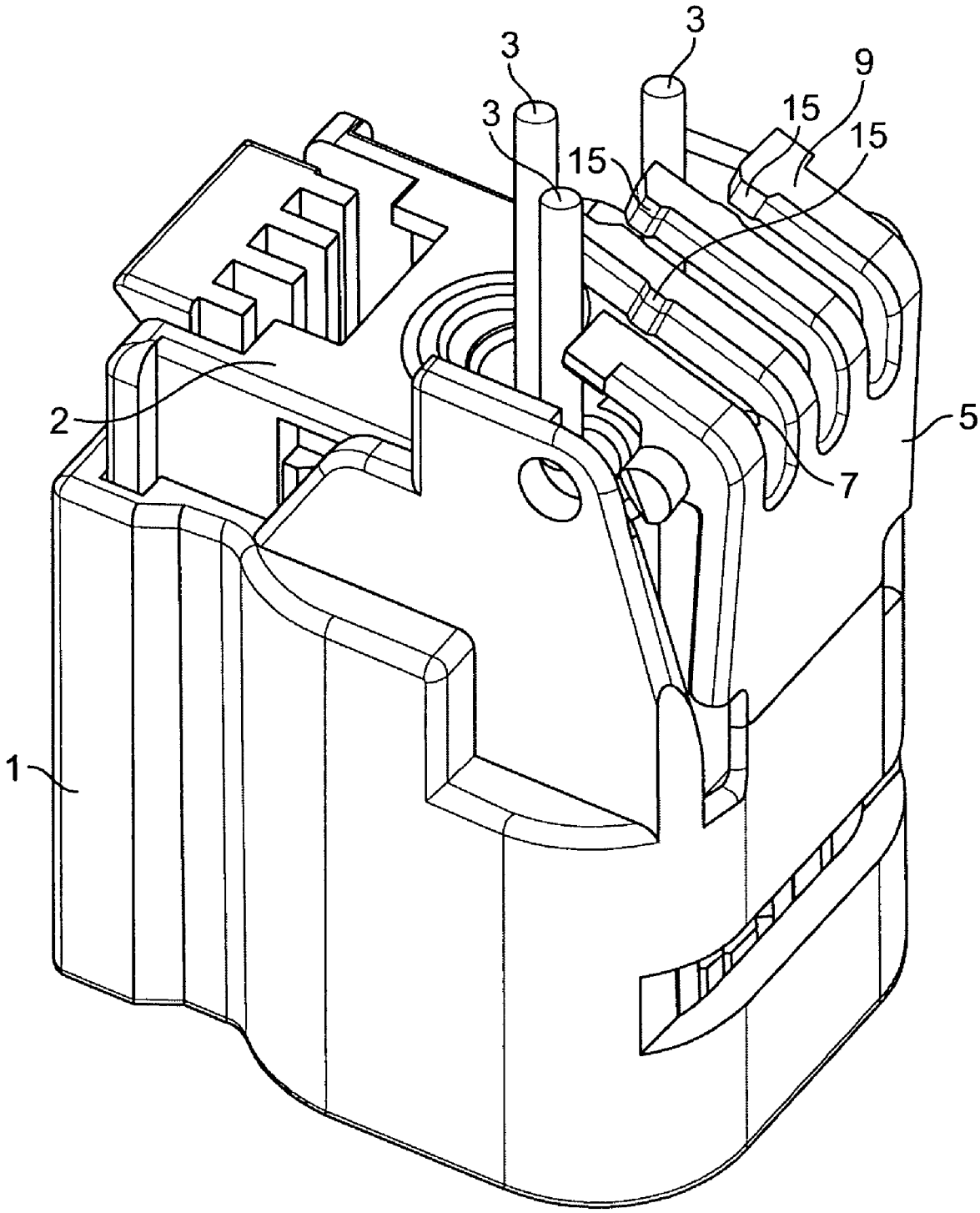
FIG. 2 is a perspective view of the connector, according to the first embodiment of the invention, in which the cover is partially closed.
Figure 3:
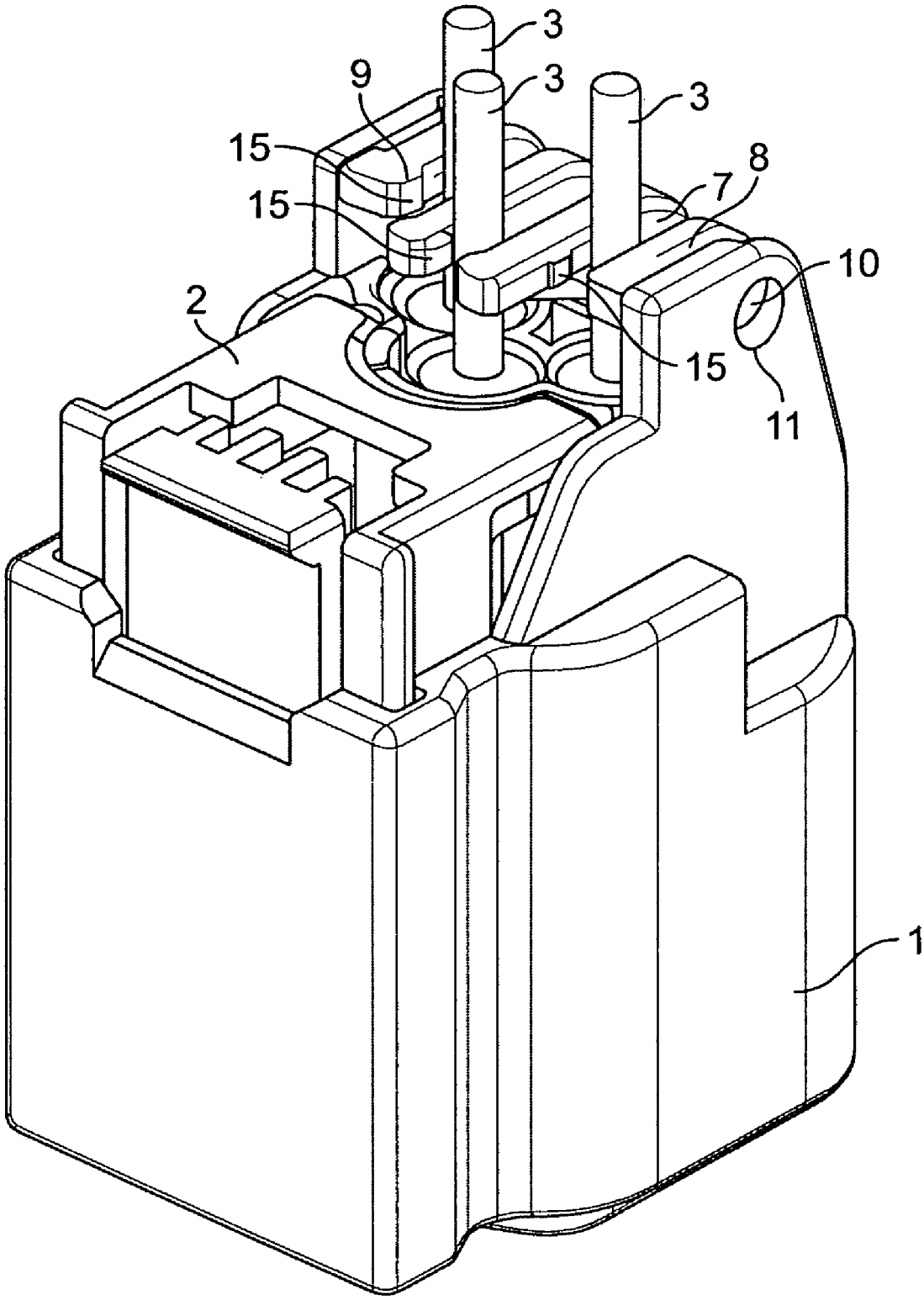
FIG. 3 is a first embodiment perspective view of the connector, according to the first embodiment of the invention, in which the cover is closed.

FIGS. 1 to 3 illustrate progression of an opening and closing of a cover, in sequence, and a view of a first embodiment of a connector according to the invention from different perspectives, respectively.

Figure 4:
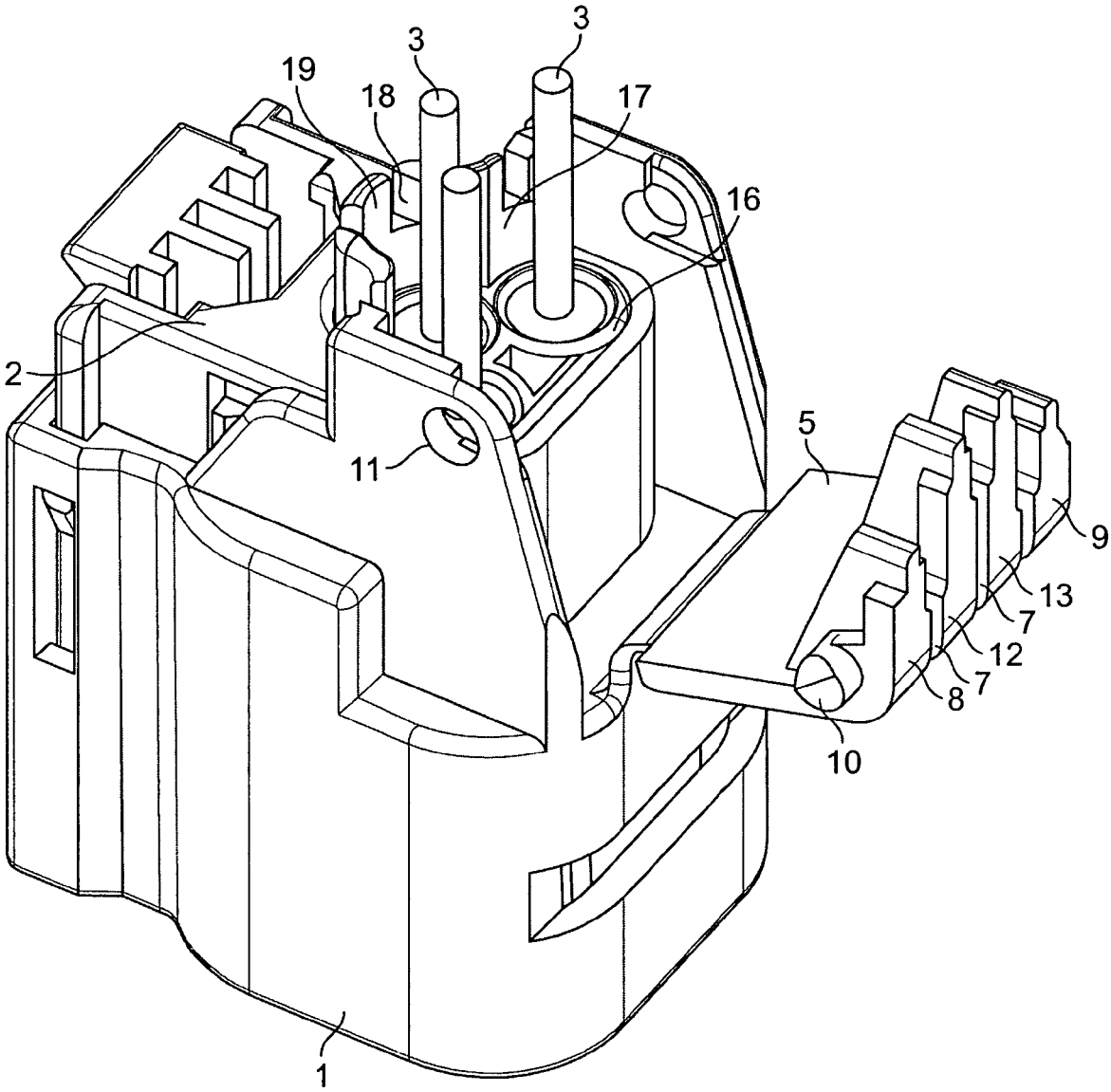
FIG. 4 is a second embodiment perspective view of the connector, according to a second embodiment of the invention, in which the cover is open.
Figure 5:
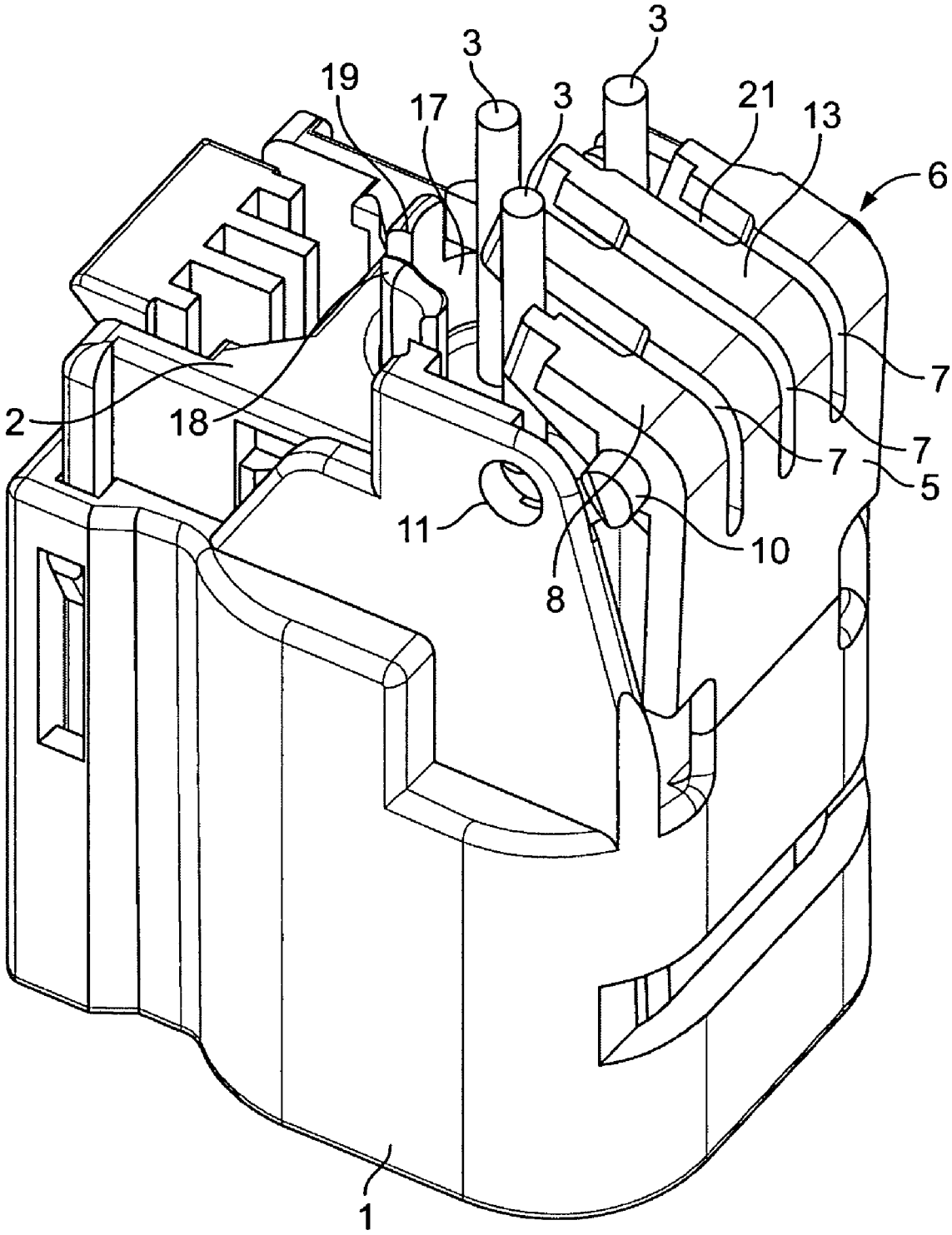
FIG. 5 is a second embodiment perspective view of the connector, according to the second embodiment of the invention, in which the cover is partially closed.
Figure 6:
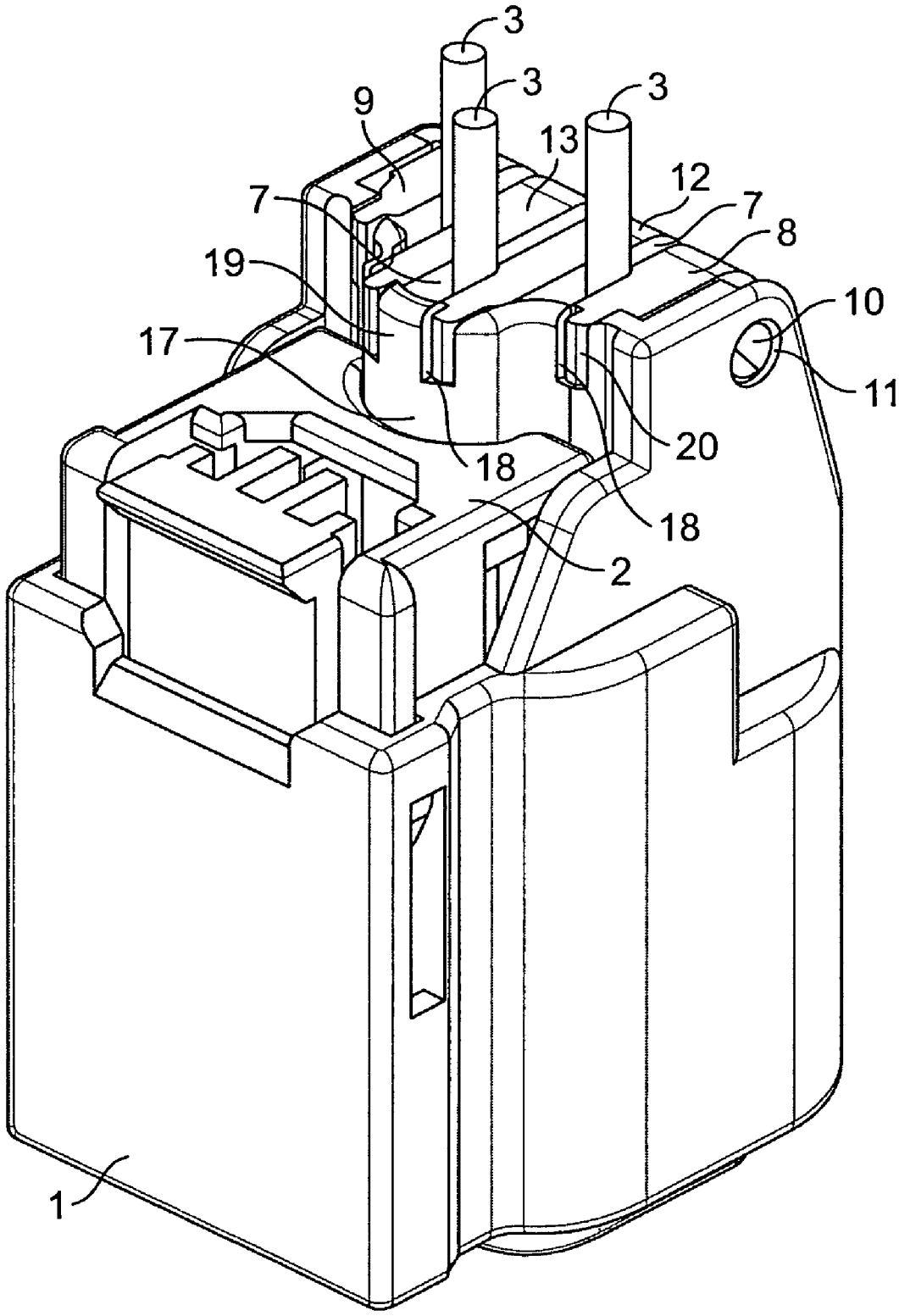
FIG. 6 is a second embodiment perspective view of the connector, according to the second embodiment of the invention, in which the assembly the cover is closed.

FIGS. 4 to 6 show a second embodiment of the connector according to the invention in the same sequence and view.

FIG. 1 shows a connector housing 1 in the form of a socket, as an example, with a cable feed side 2, and a plug side pointing downwards and not visible. Three cables 3 project out of the cable feed side 2, the ends of which are connected by crimps (line crimps and insulation crimps) to a contact (not visible), which is locked inside a contact cavity 16, as shown in FIG. 4. The contact cavity 16 is fixably arranged inside the connector housing 1.

A roughly L-shaped cover 5 is formed on a reverse side of the connector housing 1 using a thin hinge, so that it is pivotable between an open state shown in FIG. 1 and a completely closed state, which can be seen in FIG. 3. A cover portion 6 on a free side of the roughly L-shaped cover 5 (which can be shorter or longer than the side fastened to the connector housing 1) has four fingers 8, 9, 12 and 13 separated by slim, opening recesses or guide slots 7. The two outermost fingers 8 and 9 each have a respective locking pin 10 on their base, which points outwards laterally, with which the cover 5 can lock in the closed state with locking holes 11 provided on the connector housing 1. The two central fingers 12 and 13 have a longer length compared to the outermost fingers 8 and 9, which is simply a result of the predetermined arrangement of the central cable 3, which is arranged offset compared to the outermost cables 3. Considering the longer length of the central fingers 12 and 13, it is advantageous if support devices, for example, vanes 14, which can be seen in FIG. 1, are provided on their lower face.

FIG. 2 shows a state of the connector in which the person putting the assembly together has partially closed the cover 5 up to a first stop. The cables 3 can readily be "threaded in" to the guide slots 7, that is positioned in the guide slots 7, starting from this state in which they are located adjacent to the insertion openings of the guide slots 7, through simple downward pressure of the cover 5, especially since the uppermost ends of the central fingers 12 and 13 are rounded. If, however, in other embodiments there is a slight misalignment or one arises, when the cover 5 is closed, then the cables 3 can be inserted manually into the guide slots 7 by the person putting the assembly together by pulling them over slightly. It can also be seen that at least one cam 15 is provided on a side of each of the fingers 8, 9, 12 and 13, the function of which will be described in more detail below in connection with FIG. 3.

In FIG. 3, the connector according to FIGS. 1 and 2 is shown, however, with the cover 5 in the closed state. A direct forced guiding of the outermost fingers 8 and 9 attributable to side walls of the connector housing 1 causes a constriction of the two outermost guide slots 7 at the latest when the cover 5 is locked in the closed state, which transfers indirectly via the cables 3 onto the guide slots 7 located on the inside. The fixing of the cables 3 resulting from the constriction is secured even more by the cams 15, which serve as locking members for each respective guide slot 7 when the cover 5 is closed and the guide slots 7 are constricted.

In the case of the embodiment shown in FIGS. 4 to 6, the guide slots 7 are not locked by the cams 15, but by the combined effect of crenels 19 and openings 18 between them in a wall 17 extending vertically from the cable feed side 2 of the connector housing 1, with the fingers 8, 9, 12 and 13 of the cover 5. When the cover 5 is closed, free ends 20 of the fingers 8, 9, 12 and 13 are guided into the openings 18, so that the crenels 19 close the guide slots 7. The embodiment shown is further differentiated from that shown in FIGS. 1 to 3, in that at least one of the guide slots 7 has a width in a restricted region 21, as shown in FIG. 5, that is wider than a remainder of the guide slot 7 that abuts the insertion opening which suffices to position the cables 3 when the cover 5 is closed. This configuration can, however, also be used in the embodiment according to FIGS. 1 to 3. The crenels 19 and intermediate openings 18 have the further effect of being a forced guide for each of the fingers 8, 9, 12 and 13 inserted into the corresponding openings 18 when the cover 5 is closed, which leads to the constriction of the guide slots 7.

This connector according to the invention is characterized by simple assembly using tooling for its production, low overall height and compact design. It is also of particular advantage that no additional parts such as cable binders or wrapping tape are needed. Additionally, the advantage of easy workability emerges for the person putting the assembly together, as well as free access during the mounting of the contacts. Finally, the fixing of the cable also has the effect of additional strain relief. The measures according to the invention can easily be implemented both in the socket and in the plug of a connector, so that an advantageous fixing of the cable on both sides of the connector is achieved.

The foregoing illustrates some of the possibilities for practicing the invention. Many other implementations are possible within the scope and spirit of the invention. It is, therefore, intended that the foregoing description be regarded as illustrative rather than limiting, and that the scope of the invention is given by the appended claims together with their full range of equivalents. Additional implementations may be created by combining, deleting, modifying, or supplementing various features of the disclosed implementations.

What is claimed is:

1. An electrical connector, comprising:

a connector housing having a plug side and a cable feed side;

a hinged cover, which is connected to the connector housing and is arranged between the plug side and the cable feed side, so that a portion of the cover forms part of the connector housing on the cable feed side when the cover is closed;

at least one guide slot being formed in the cover portion opening outwards towards a free end of the cover portion, in which at least one associated cable can be positioned upon closing the cover, while the guide slot is constricted so that the cable is fixed inside the guide slot, wherein the guide slot is formed by fingers; and at least one cam attached to the side of each respective finger in an insertion region of the guide slot, wherein the cam acts as a closure member when the cover is closed thereby constricting the guide slot.

2. The electrical connector according to claim 1, wherein the outwards opening guide slot is configured so the outwards opening guide slot can be closed in order to fix the cables securely.

3. The electrical connector according to claim 1, wherein the at least one guide slot has a width in one restricted region abutting an insertion opening, which suffices to position the cables there upon closing the cover.

4. The electrical connector according to claim 1, further comprising at least one locking pin arranged laterally on the exterior of the cover portion respectively, which locks with the connector housing when the cover is closed.

5. A connector housing with a plug side and a cable feed side, comprising:

a hinged cover, which is fastened in one piece to the connector housing and is arranged between the plug side and the cable feed side, so that a cover portion of the cover forms part of the connector housing on the cable feed side when the cover is closed; and at least one guide slot being formed in the cover portion, the guide slot opening outwards towards the free end of the cover portion, in which at least one associated cable can be positioned upon closing the cover, while the guide slot is constricted when the cover is closed so that the cable is fixed inside the guide slot, wherein the guide slot is formed by fingers; and at least one cam attached to the side of each respective finger in an insertion region of the guide slot, wherein the cam acts as a closure member when the cover is closed thereby constricting the guide slot.

6. An electrical connector, comprising:

a connector housing having a plug side and a cable feed side;

a hinged cover, which is connected to the connector housing and is arranged between the plug side and the cable feed side, so that a portion of the cover forms part of the connector housing on the cable feed side when the cover is closed;

at least one guide slot being formed in the cover portion opening outwards towards a free end of the cover portion, in which at least one associated cable can be positioned upon closing the cover, while the guide slot is constricted so that the cable is fixed inside the guide slot, wherein the guide slot is formed by fingers; and wherein the connector housing further comprises a wall extending vertically from the cable feed side, the free end of which is crenellated with one opening for each respective finger of the cover, free ends of the fingers being guided into the opening when the cover is closed so that the crenels seal the guide slot.

7. The electrical connector according to claim 6, wherein the free ends of the fingers are each forcefully guided into the respective openings bordered by the crenels when the cover is closed, so that the guide slot is constricted.

8. The electrical connector according to claim 6, wherein the outwards opening guide slot is configured so the outwards opening guide slot can be closed in order to fix the cables securely.

9. The electrical connector according to claim 6, wherein the at least one guide slot has a width in one restricted region abutting an insertion opening, which suffices to position the cables there upon closing the cover.

10. The electrical connector according to claim 6, further comprising at least one locking pin arranged laterally on the exterior of the cover portion respectively, which locks with the connector housing when the cover is closed.

11. A connector housing with a plug side and a cable feed side, comprising:

a hinged cover, which is fastened in one piece to the connector housing and is arranged between the plug side and the cable feed side, so that a cover portion of the cover forms part of the connector housing on the cable feed side when the cover is closed; and at least one guide slot being formed in the cover portion, the guide slot opening outwards towards the free end of the cover portion, in which at least one associated cable can be positioned upon closing the cover, while the guide slot is constricted when the cover is closed so that the cable is fixed inside the guide slot, wherein the guide slot is formed by fingers; and wherein the connector housing further comprises a wall extending vertically from the cable feed side, the free end of which is crenellated with one opening for each respective finger of the cover, free ends of the fingers being guided into the opening when the cover is closed so that the crenels seal the guide slot.

* * * * *